United States Patent [19]

Gropp

[11] 4,150,649

[45] Apr. 24, 1979

[54] LOAD RESPONSIVE EGR VALVE

[75] Inventor: Karl H. Gropp, Grosse Pointe Woods, Mich.

[73] Assignee: Ford Motor Company, Dearborn, Mich.

[21] Appl. No.: 865,034

[22] Filed: Dec. 27, 1977

[51] Int. Cl.[2] ..... F02M 25/06

[52] U.S. Cl. ..... 123/119 A

[58] Field of Search ..... 123/119 A

[56] References Cited

U.S. PATENT DOCUMENTS

| | | | |
|---|---|---|---|
| 3,713,428 | 1/1973 | Sandhagen | 123/119 A |
| 3,800,765 | 4/1974 | Thompson | 123/119 A |
| 3,878,823 | 4/1975 | Vartanian | 123/119 A |
| 3,885,538 | 5/1975 | Suter | 123/119 A |
| 3,962,868 | 6/1976 | Matumoto et al. | 123/119 A |
| 4,052,969 | 10/1977 | Ando et al. | 123/119 A |

FOREIGN PATENT DOCUMENTS

| | | | |
|---|---|---|---|
| 2166337 | 9/1973 | Fed. Rep. of Germany | 123/119 A |
| 2365341 | 11/1974 | Fed. Rep. of Germany | 123/119 A |
| 2453160 | 5/1975 | Fed. Rep. of Germany | 123/119 A |
| 2528760 | 12/1976 | Fed. Rep. of Germany | 123/119 A |

*Primary Examiner*—Wendell E. Burns

*Attorney, Agent, or Firm*—Robert E. McCollum; Clifford L. Sadler

[57] ABSTRACT

An engine exhaust gas recirculation (EGR) valve assembly consists of twin force actuating mechanisms within a single housing provided by two spaced flexible diaphragms one of which engages the another at times to control movement of the EGR valve, the diaphragms defining a lower manifold vacuum chamber connected to the EGR valve, an intermediate atmospheric pressure chamber, and an upper ported or spark port vacuum chamber, to provide an EGR flow schedule that varies as a function of engine load.

4 Claims, 2 Drawing Figures

FIG. 1
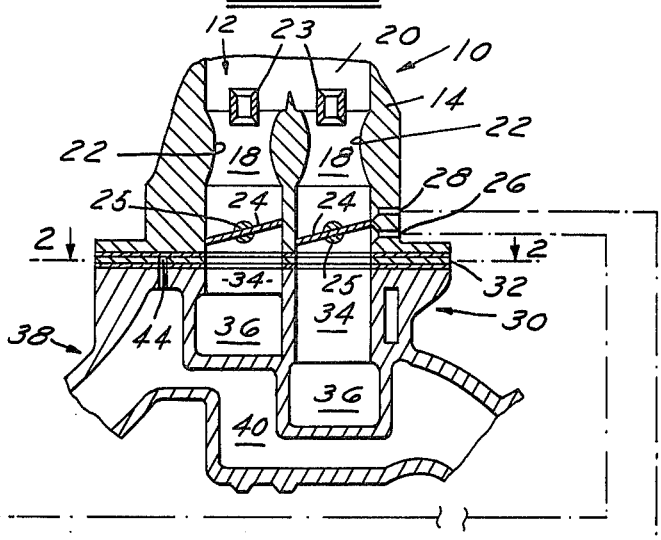
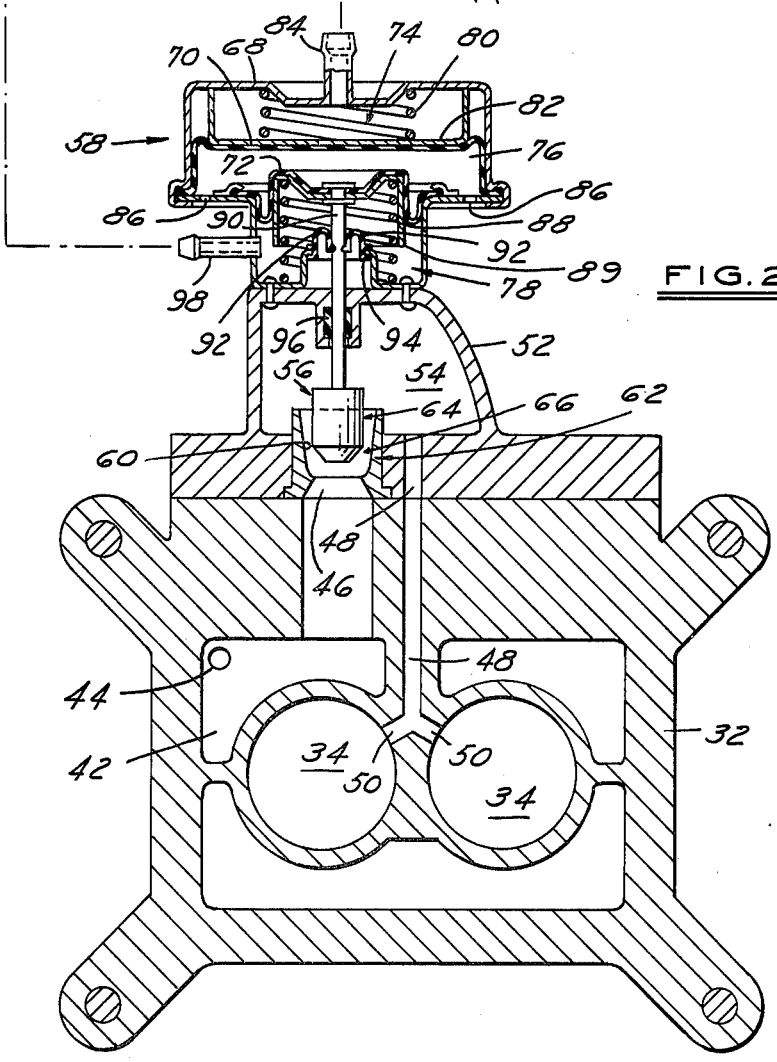
FIG. 2

LOAD RESPONSIVE EGR VALVE

This invention relates in general to an automotive type engine exhaust gas recirculation (EGR) system. More particularly, it relates to an EGR valve assembly that is responsive to engine load for scheduling the flow of EGR.

It is well known that an engine's tolerance to EGR flow increases with load. That is, the engine can ingest more exhaust gas with increased load before reaching a threshold where additional EGR would result in incomplete combustion and associated higher hydrocarbons. It is, therefore, desirable to schedule the required EGR flow as a function of engine load. Since intake manifold vacuum is a relative indicator of load, the EGR valve position can be established as a function of the change in the manifold vacuum level. At light loads, for example, when only a small amount of EGR is necessary to control $No_x$ levels, the valve of this invention opens only slightly to allow a small amount of EGR flow. At heavier loads, greater EGR flow is required because of the higher pressure and temperature levels in the combustion chamber. Accordingly, the EGR valve opens wider to permit greater EGR flow.

The use of manifold vacuum to control EGR flow is not new. For example, U.S. Pat. No. 4,009,700, Engels et. al, shows a construction in which an EGR valve is controlled indirectly by a manifold vacuum and ported or spark port vacuum by the use of a pilot valve. FIG. 5, for example, shows manifold vacuum applied to a pilot valve to control flow of vacuum through another line to the EGR valve.

U.S. Pat. No. 3,877,452, Nohira et al; U.S. Pat. No. 3,924,589, Nohira et al; U.S. Pat. No. 4,040,402, Nohira et al; U.S. Pat. No. 3,881,456, Nohira et al; and U.S. Pat. No. 4,033,309, Hayashi et al, all illustrate other devices for controlling an EGR valve through the use of manifold vacuum and ported or spark port vacuum through a pilot valve. It is to be noted that in each of the above prior art devices, there is no single control device operatively connected to the EGR valve and operative as a function of the changes in manifold vacuum and ported or spark port vacuum levels. All of the prior art devices show a pilot valve control that intercepts the manifold or ported vacuum for transmittal of a modified signal to the EGR valve. These types of constructions render the EGR assembly more expensive to manufacture, more complicated to assemble, and more expensive to repair.

It is an object of this invention to provide an EGR valve assembly that consists of a single unitary housing containing movable force members responsive to changes in manifold vacuum level and ported vacuum or spark port vacuum that is controlled in response to the movement of the conventional carburetor throttle valve, to control EGR flow as a function of engine load changes.

It is another object of the invention to provide an EGR valve assembly consisting of a pair of force units housed in a single shell or housing, the force units at times engaging to control the position of the EGR valve and at other times being moved in response to changes in the manifold vacuum levels and ported vacuum levels to separate the two force units to permit independent movement of the EGR valve by one of the units.

It is a still further object of the invention to provide an EGR valve assembly consisting of a single housing containing a pair of spaced flexible diaphragms defining with the housing a ported vacuum chamber, an atmospheric pressure chamber, and a manifold vacuum chamber, the latter being connected to the EGR valve to effect reciprocatory movement of the valve in response to changes in manifold vacuum level, spring forces, and variances in ported or spark port vacuum levels.

Other objects, features and advantages of the invention will become more apparent upon reference to the succeeding detailed description thereof, and to the drawings illustrating the preferred embodiment thereof; wherein FIG. 1 is a cross-sectional view of a portion of an internal combustion engine and associated carburetor embodying the invention;

FIG. 2 is a cross-sectional view taken on a plane indicated by and viewed in the direction of the arrows 2—2 of FIG. 1; and FIG. 1 illustrates a portion 10 of a two-barrel carburetor of a known downdraft type. It has an air horn section 12, a main body portion 14, and a throttle body 16, joined by suitable means not shown. The carburetor has the usual air/fuel induction passages 18 open at their upper ends 20 to fresh air from the conventional air cleaner, not shown, and connected at their lower ends to the engine intake manifold 30. The passages 18 have the usual fixed area venturies 22 cooperating with booster venturies 23 through which the main supply of fuel is induced, by means not shown.

Flow of air and fuel through induction passages 18 is controlled by a pair of throttle valve plates 24 each fixed on a shaft 25 rotatably mounted in the side walls of the carburetor body.

The induction passages also contain a manifold vacuum sensing port 26 and a ported or so called spark port vacuum sensing port 28. The latter is adjacent the edge of the throttle valve in its closed position so as to be traversed by the edge as the throttle valve moves to open positions. This progressively exposes the port to manifold vacuum and thus provides a port vacuum level that varies as a function of throttle valve position.

The throttle body 16 is flanged as indicated for bolting to the top of the engine intake manifold 30, with a spacer element 32 located between. Manifold 30 has a number of vertical risers or bores 34 that are aligned for cooperation with the discharge end of the carburetor induction passages 18. The risers 34 extend at right angles at their lower ends 36 for passage of the mixutre out of the plane of the figure to the intake valves of the engine.

The exhaust manifolding part ot the engine cylinder head is indicated partially at 38, and includes an exhaust gas crossover passage 40. The latter passes from the exhaust manifold, not shown, on one side of the engine to the opposite side beneath the manifold trunks 36 to rpovide the usual "hot spot" beneath the carburetor to better vaporize the air/fuel mixture.

As best seen in FIG. 2, the spacer 32 is provided with a worm-like recess 42 that is connected directly to crossover passage 40 by a bore 44. Also connected to passage 42 is a passage 46 alternately blocked or connected to a central bore or passage 48 communicating with the risers 34 through a pair of ports 50. Mounted to one side of the spacer is a cup-shaped boss 52 forming a chamber 54 through which passages 46 and 48 are interconnected.

To prevent the recirculation of exhaust gases at undesirable times, passage 46 normally is closed by an EGR valve 56 that is sensitive to load and moved to an open position by a servo 58. EGR valve 56 in this case is illustrated as being a sonic flow control valve, such as is fully shown and described in U.S. Pat. No. 3,981,283, Kaufman. The walls 60 of the valve seat 62 are shaped so as together with the conical like plug valve 56 form a convergent-divergent flow passage 64 with sonic flow at the throat 66 between the two for each position of the movable plug valve 56.

Servo 58 consists of an assembly of a pair of separate but interacting force mechanisms within a single housing 68. Two annular flexible diaphragms, one at 70 and a larger area one at 72, divide housing 68 into three distinct pressure chambers, an upper chamber 74 between the housing and diaphragm 70, an intermediate chamber 76 between the two diaphragms, and a lower chamber 78 between diaphragm 72 and housing 68.

Upper chamber 74 contains a compression spring 80 biasing downwardly a cup-shaped piston 82 fixed to diaphragm 70. The chamber is connected by an adapter 84 to ported vacuum line 28 in FIG. 1 so as to be responsive to throttle valve vacuum changes.

Intermediate chamber 76 is connected to atmospheric or ambient pressure conditions through a number of vent ports 86.

The lower chamber 78 contains a compression spring 88 biasing upwardly a cup-shaped piston 89 fixed to the diaphragm 72. Also fixed to the piston and diaphragm is the stem 90 of the EGR valve 56. The stem passes through an annular rolling seal 92 sealing an opening 94 in shell 68 through which the stem reciprocates. The stem also passes through a lubricator 96. Chamber 78 is connected by an adapter 98 to the engine manifold vacuum port 26 in FIG. 1 so as to be responsive to changes in load.

Before proceeding to the overall operation, it should be noted that in the at rest positions of the parts, the upper chamber spring 80 is calibrated to overcome the force of the oppositely acting lower chamber spring 88. Also, the upper piston 82 constitutes one force mechanism, and lower piston 89 a second force mechanism, the upper one biasing the lower one down at times to seat the EGR valve and at other times the upper one moving up away from the lower one to permit independent movement of the EGR valve as a function of changes in load.

In operation, the parts are illustrated in FIG. 2 in the positions attained during engine OFF conditions as well as engine ON, wide-open throttle conditions. Under both circumstances, the pressure in chambers 74 and 78 is atmospheric in that with the engine off, no engine vacuum is generated, and at wide-open throttle conditions, the vacuum is essentially zero and, therefore, at atmospheric pressure levels. Accordingly, the force of spring 80 in the upper chamber being greater than the force of spring 88 in the lower chamber causes piston 82 and diaphragm 70 to engage the lower diaphragm 72 and push the piston 89 downwardly, carrying with it the stem 90 of EGR valve 56 to seat the same and close off the passage 46.

During an engine ON, idle speed condition of operation, the manifold vacuum level in lower chamber 78 will be high and sufficient to overcome the force of spring 88 to pull down the diaphragm 72 and piston 89 and therefore seat the EGR valve 56 to prevent EGR flow. The upper chamber 74, at this time, remains at atmospheric pressure conditions because the throttle valve is in closed position and the port 28 is exposed to the essentially atmospheric or ambient pressure conditions in the air horn section 12 of the carburetor.

During light vehicle acceleration condition of operation, opening movement of the throttle valve 24 traverses the ported or spark port vacuum port 28 and accordingly exposes the same to manifold vacuum that will vary progressively as the throttle valve is opened wider. Accordingly, chamber 74 is now exposed to manifold or spark port vacuum which, when it overcomes the force of spring 80, will draw the piston 82 upwardly and away from engagement or contact with the lower diaphragm 72 and piston 89. At the same time, the manifold vacuum in lower chamber 78 will decrease until a point is reached where the force of spring 88 begins moving the diaphragm 72 and piston 89 upwardly to progressively open the EGR valve 56. This is permitted independently of the movement of the upper piston 82 because, as stated above, the piston 82 has moved away from contact with the lower piston.

During heavier vehicle acceleration, the EGR valve 56 will progressively open wider as the manifold vacuum decreases further permitting the spring 88 to move the piston 89 upwardly. This will continue until such time as the manifold vacuum level decreases in spark port vacuum port 28 to such a low value as to be nearly atmospheric pressure conditions in upper chamber 74. Accordingly, the spring 80 now will move the piston 82 and diaphragm 70 downwardly to abut the lower diaphragm 72 and accordingly move the same with piston 89 downwardly to then shut the EGR valve 56.

From the above, it will be seen that the EGR valve assembly controls the EGR flow as a function of load; that at idle and wide-open throttle conditions of operation, the EGR valve is maintained closed, and the EGR flow is scheduled as a function of load changes during part throttle operation as a function of movement of the throttle valve controlling the pressure in the ported vacuum port 28. It will also be seen that with engine OFF, the EGR valve is maintained closed during engine cranking so that hard starting caused by flow of EGR gases will not occur.

While the invention has been shown and described in its preferred embodiment, it will be clear to those skilled in the arts to which it pertains that many changes and modifications may be made thereto without departing from the scope of the invention.

I claim:

1. An engine exhaust gas recirculating (EGR) valve assembly for an internal combustion engine having a carburetor mounted thereon with an induction passage connected to the intake manifold at one end, a throttle valve, a port opening into the passage at a location to be traversed by the edge of the throttle valve as it moves from a closed to an open position to provide a ported vacuum level changing as a function of the position of the throttle valve, comprising in combination, a duct connecting engine exhaust gases to the engine intake manifold, an EGR valve movable into and out of the duct to block or permit flow of gases through the duct, and control means to control movement of the EGR valve including a spring for opening the EGR valve, the EGR valve being movable to a closed position by manifold vacuum applied thereto, force means urging the EGR valve to a closed position against the action of the spring, and other means operated by ported vacuum for rendering the force means ineffective to move the EGR valve whereby thereafter the EGR valve will be moved between open and closed position solely as a function of the spring force and manifold vacuum level.

2. An engine exhaust gas recirculating (EGR) valve assembly for an internal combustion engine having a carburetor mounted thereon with an induction passage connected to the intake manifold at one end, a throttle valve, a port opening into the passage at a location to be traversed by the edge of the throttle valve as it moves from a closed to an open position to provide a ported vacuum level changing as a function of the position of the throttle valve, comprising in combination, a duct connecting engine exhaust gases to the engine intake manifold, an EGR valve movable into and out of the duct to block or permit flow of gases through the duct, and control means to control movement of the EGR valve including first spring means biasing the EGR valve to an open position, manifold vacuum responsive means urging the EGR valve to a closed position in opposition to the force of the first spring means, second spring means operatively engageable at times with the first spring means, and means acting in a direction opposite to that of the first spring means to move the first spring means and EGR valve in an EGR valve closing direction, and means responsive to a predetermined ported vacuum level operatively acting on the second spring means to retract the second spring means away from engagement with the first spring means to thereafter permit the EGR valve to be opened and closed as a sole function of the changes in manifold vacuum and the force of the first spring means.

3. An EGR valve assembly as in claim 2, including a housing having a pair of mutually adjacent spaced flexible wall members dividing the housing into a first chamber connected to manifold vacuum, and a second chamber connected to ported vacuum, and a third chamber between the first and second chambers connected to atmospheric pressure, means connecting the first chamber wall member to the EGR valve, the first spring means acting against the first wall member, the second spring means biasing the second wall member towards the first wall member to at times engage and move the first wall member and EGR valve towards a closed EGR valve position.

4. An EGR valve assembly as in claim 3, the second wall member being of larger force area than the first wall member.

* * * * *